US007007819B2

(12) United States Patent
Pollack

(10) Patent No.: US 7,007,819 B2
(45) Date of Patent: Mar. 7, 2006

(54) PHOTO DISPLAY DRINKING CONTAINER FOR CHILDREN

(76) Inventor: Leah Pollack, 28524 Calex Dr., Valencia, CA (US) 91354

( * ) Notice: Subject to any disclaimer, the term of this patent is extended or adjusted under 35 U.S.C. 154(b) by 187 days.

(21) Appl. No.: 10/459,932

(22) Filed: Jun. 12, 2003

(65) Prior Publication Data

US 2004/0035875 A1 Feb. 26, 2004

Related U.S. Application Data

(60) Provisional application No. 60/404,812, filed on Aug. 20, 2002.

(51) Int. Cl.
*B65D 25/54* (2006.01)

(52) U.S. Cl. ..... 220/662; 220/665; 220/914

(58) Field of Classification Search ..... 220/662, 220/665, 914

See application file for complete search history.

(56) References Cited

U.S. PATENT DOCUMENTS 5,890,620 A 4/1999 Belcastro
2003/0024895 A1 * 2/2003 Meyers et al. ..... 215/11.5

* cited by examiner

*Primary Examiner*—Joseph C. Merek

(57) ABSTRACT

This invention is a photo display drinking container for children. The container includes a hollow vessel (12) surrounded by a clear outer casing (10). The clear outer casing (10) is open at the bottom, forming a display space (21) between the hollow vessel (12) and the clear outer casing (10). The display space (21) is for the purpose of easy insertion and removal of personalized photographs or decorations (20). A clear bottom lid (11), connected to the clear outer casing (10), prevents the decorations (20) from falling out of the display space (21). The clear bottom lid (11) is removable, and pictures can be inserted and removed frequently. A top lid (13) protects contents of the hollow container vessel (14) during the insertion and removal of decorations (20).

3 Claims, 5 Drawing Sheets

PHOTO DISPLAY DRINKING CONTAINER FOR CHILDREN

CROSS-REFERENCE TO RELATED APPLICATIONS

This application is entitled to the benefit of Provisional Patent Application Ser. No. 60/404,812 filed 2002 Aug. 20.

FEDERALLY SPONSORED RESEARCH

Not Applicable

SEQUENCE LISTING OR PROGRAM

Not Applicable

BACKGROUND OF INVENTION—FIELD OF INVENTION

This invention relates to displaying removable photographs on a drinking container for children, specifically to allow the photographs to be easily inserted and removed without disturbing the contents of the cup through the use of a clear outer-cup casing and clear bottom lid.

BACKGROUND OF INVENTION—PRIOR ART

Children bring their own drinking cup to daycare or school. Parents give their child current pictures of themselves or other relatives to take with them to school. The pictures assist in easing separation anxiety. Displaying removable photographs on a drinking vessel is currently available on the market for adults only. Darice Inc. markets a Design-A-Mug product. There are no patent numbers available on the product or packaging. "Design-A-Mug" includes a clear plastic mug, an inner-cup and three custom inserts for decorating. The inner-cup is removed to insert the custom-sized decoration. Custom inserts fit between the plastic mug and the inner-cup. The custom inserts are approximately 8.89 cm high and 26.03 cm long. Instructions for the Design-A-Mug include: decorate custom inserts; put custom inserts inside plastic mug; snap inner-cup into place to secure insert. The Design-A-Mug is the size of an adult mug and is too large to be held securely by a young child. The Design-A-Mug does not have a lid. Without a lid Design-A-Mug can not secure the contents of the cup during the insertion or removal of the custom decoration.

Starbucks, Inc. markets a "Create your own Tumbler" product. This product shows Patent Pending on the product and packaging. The "Create your own Tumbler" includes an insulated coffee mug, a coffee-sip top lid, a clear outer-cup casing and a bottom lid. The bottom lid is removed to insert a custom-sized template for decoration. The custom insert fits between the outer-cup casing and the inner-cup. The custom template is cone shaped with approximate dimensions of: 15.88 cm high, 24.13 cm long at the top, 18.42 cm long at the bottom and. Instructions for the Create your own Tumbler include: twist off base and remove inner template; paste images to back of template, allow adhesive to dry; trim off edges of any images that overhang template; reinsert template and twist on base. The Tumbler is large and too heavy for a young child to hold securely. The Tumbler is dependent on custom templates to display decorations. The custom templates require a lot of time to complete due to needing the glue to dry. This may work for some people, but busy parents may not have the extra time.

In U.S. Pat. No. 5,890,620 to Belcastro (1999) the internal mechanism for the training lid for children is discussed. The outer-cup surface is not mentioned in the Belcastro patent. On the market the training cups are usually made of monochrome or decorative plastic. There are no references to a clear outer casing and clear bottom lid used with a hollow container and a children's training lid. There is no mention of a clear outer casing and removable bottom lid to be used to insert and remove photographs or decorations.

A type of silk-screening method currently exists to display personalized decorations on a children's training cup. This process places a permanent copy of a photo or decoration on the outer surface of the cup. Children get bored easily and placing a permanent personalized decoration on a cup may make the cup obsolete or undesirable to a child. The children's photo display cup allows for the decoration to be changed frequently.

Decoration display containers on the market are designed where you either need to disturb the contents within the cup, or you need to manipulate the decorations by attaching it to a custom-sized paper backing and then insert the completed art into the cup's outer casing. A large amount of time and effort is required to prepare the decoration. The backing needs to be customized, as it is non-standard in size. Furthermore, effort is needed to secure the desired personalized decoration to this backing, to avoid the completed art from falling apart within the outer cup casing.

BACKGROUND OF INVENTION—OBJECTIVES AND ADVANTAGES

The objects and advantages of the photo display cup for children are:

(a) to display and insert removable photographs on a container through the use of a clear outer casing and clear bottom lid without disturbing the contents within the container through the use of a training top lid;

(b) to have the photograph insertion and removal be done easily and frequently through the use of a clear bottom lid;

(c) to provide a functional photo display container for children;

(d) Predetermined photographs or decorations do not require special backing, further mounting or preparation to be inserted. In this example the children's cup fits wallet sized photographs or decorations.

SUMMARY

A photo display container for children allows photographs to be inserted and removed easily through the use of a clear outer casing with an opening at the bottom. The photographs are secured from falling out the bottom opening of the outer casing through the use of a clear bottom lid connected to the outer casing.

DRAWINGS—FIGURES

Figure 1A:
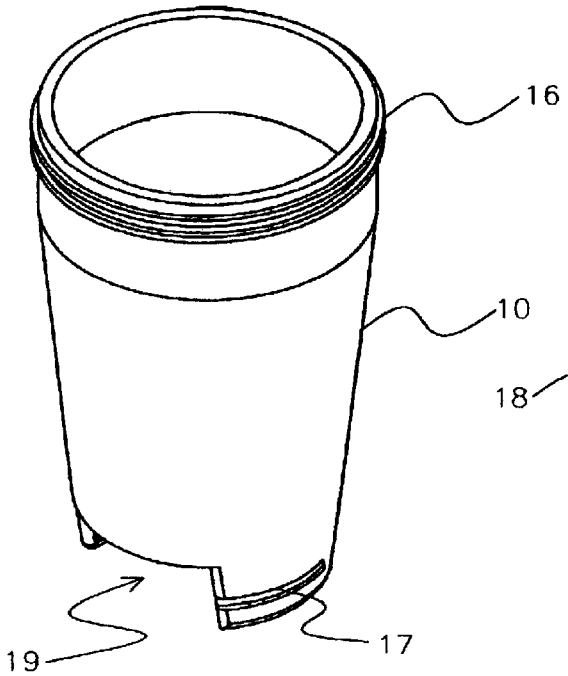
FIG. 1A shows the clear outer casing.
Figure 1B:
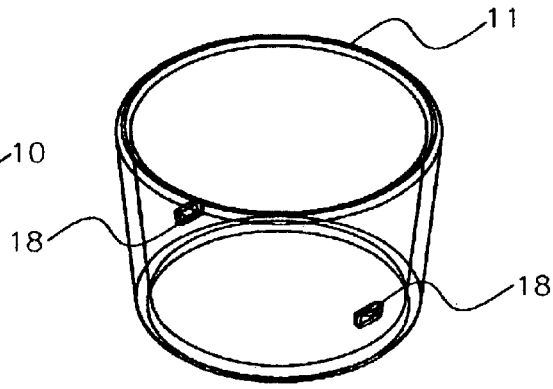
FIG. 1B shows the clear bottom lid.
Figure 1C:
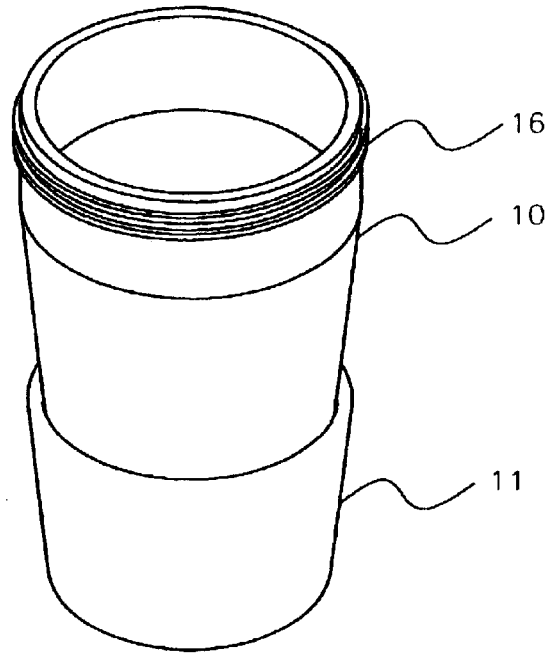
FIG. 1C shows the clear outer casing connected to the clear bottom lid.
Figure 2A:
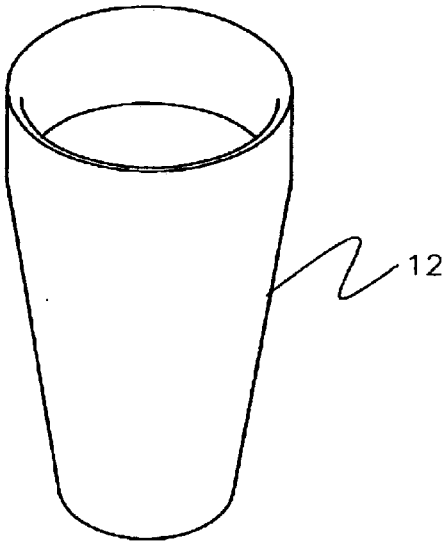

FIG. 2*a* shows the hollow container vessel.

Figure 2B:
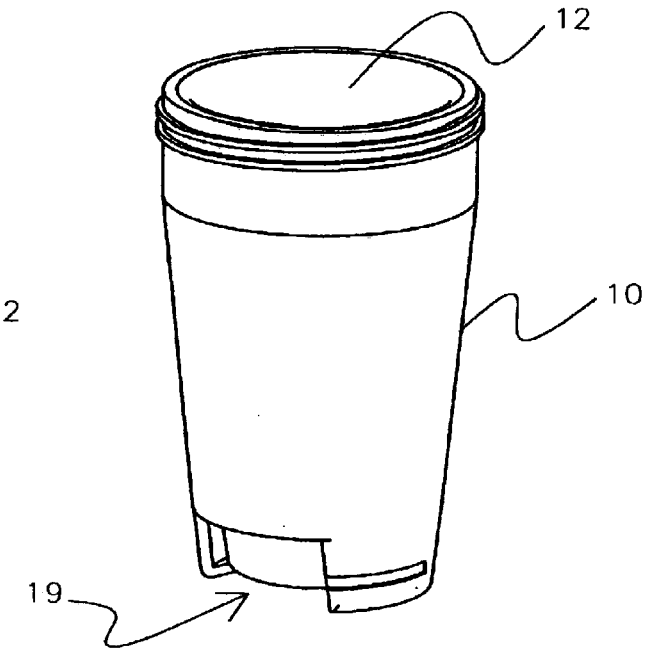

FIG. 2*b* shows the hollow container connected to the outer casing.

Figure 2C:
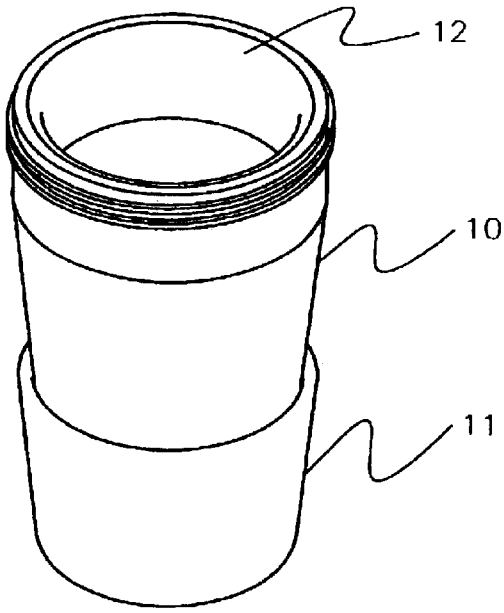

FIG. 2*c* shows hollow container connected to the outer casing and the clear bottom lid connected to the outer casing.

Figure 3A:
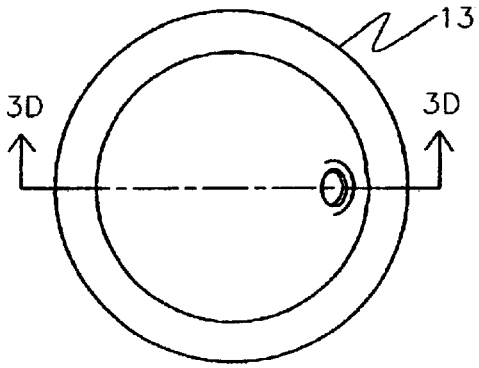

FIG. 3A shows a top view of the prior art, a children's training lid.

Figure 3B:
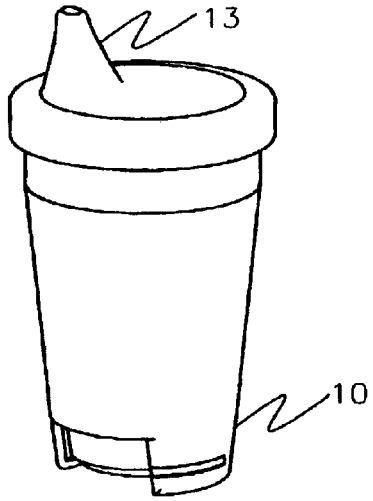

FIG. 3B shows the hollow vessel connected to the outer casing with the children's training lid connected to the top of the outer casing.

Figure 3C:
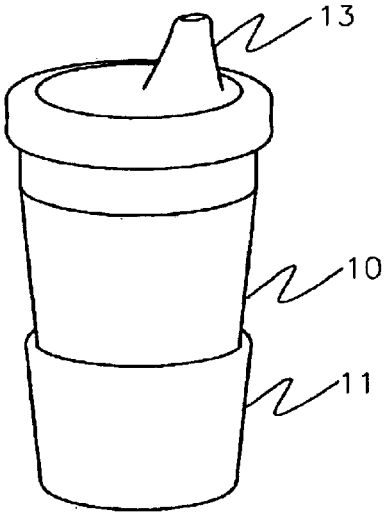

FIG. 3C shows the outer casing with the children's training lid connected to the top of the outer casing and the clear bottom lid connected to the bottom of the clear outer casing.

Figure 3D:
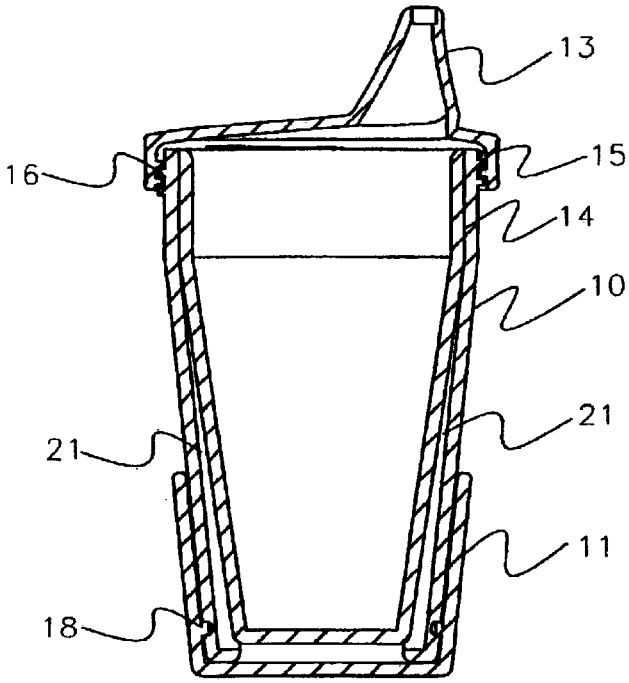

FIG. 3D shows a cross-section of the hollow vessel connected to the outer casing forming the display space. The children's training lid is connected to the top of the outer casing and the clear bottom lid is connected to the bottom of the clear outer casing.

Figure 4A:
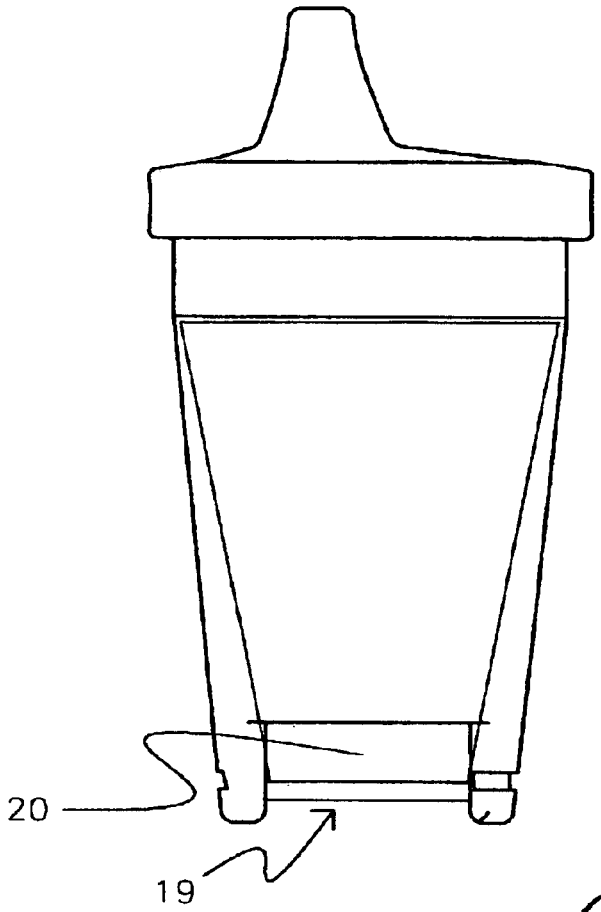

FIG. 4A shows the front of the container and outer casing with the top lid secure and with a predetermined photograph example inserted between the hollow vessel and the clear outer casing.

Figure 4B:
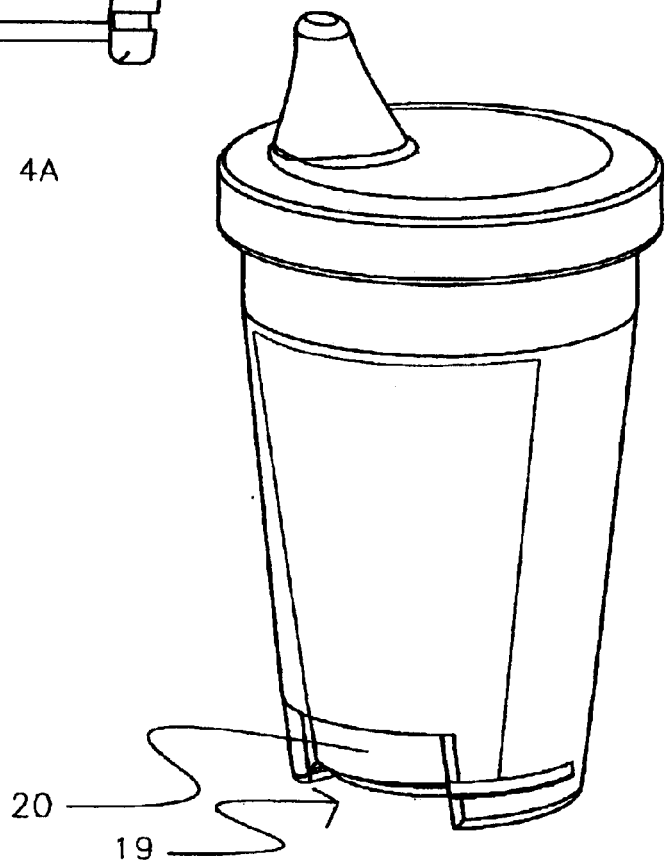

FIG. 4B shows a three quarter view of the container and outer casing with the top lid secure and with a predetermined decoration example inserted between the hollow vessel and the clear outer casing.

Figure 5A:
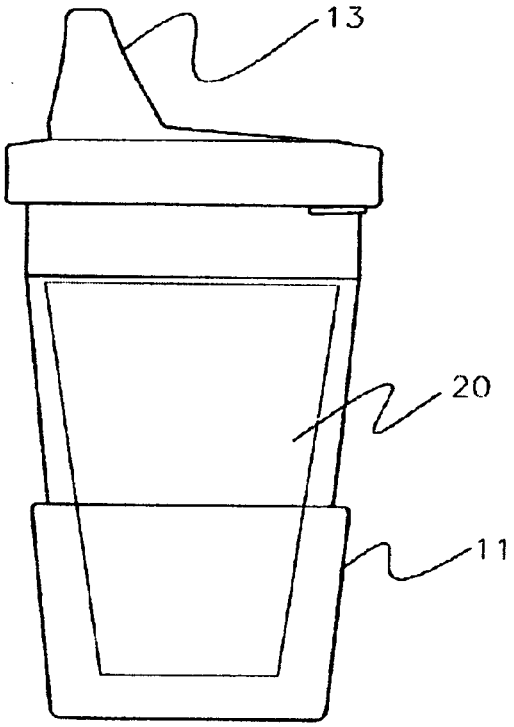

FIG. 5A shows the front view of the completed container with an outer casing, top lid, bottom lid, and inserted predetermined photograph example.

Figure 5B:
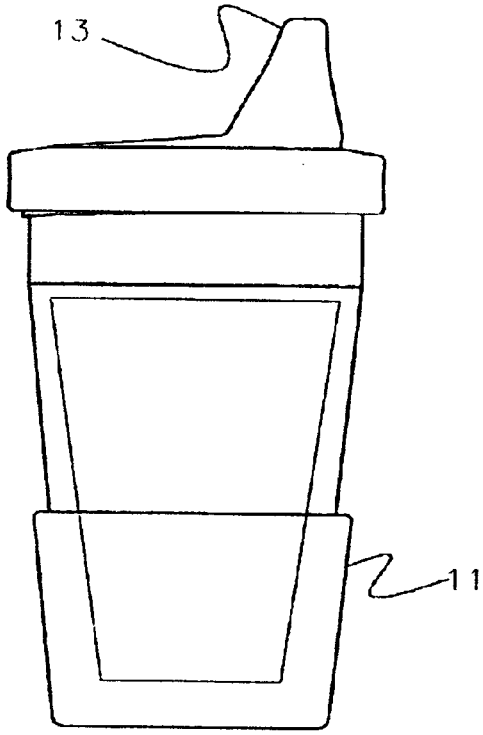

FIG. 5B shows the back view of the completed container with an outer casing, top lid, bottom lid, inserted predetermined decoration example.

Figure 5C:
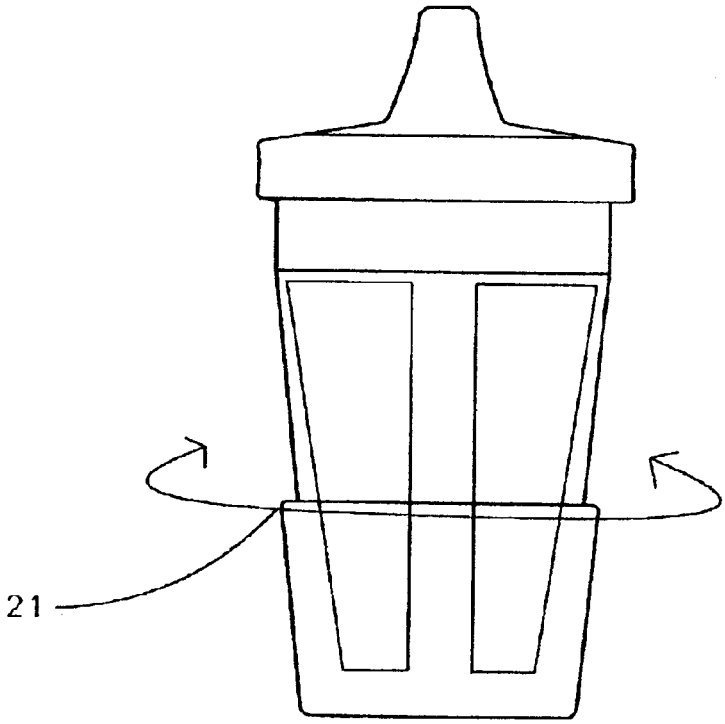

FIG. 5C shows a side view of the completed container with an outer casing, top lid, bottom lid, inserted predetermined decoration example and inserted predetermined photograph example.

DRAWINGS—REFERENCE NUMERALS

10 Clear outer casing
11 Clear bottom lid
12 Hollow container vessel
13 Children's training top lid
14 Stop barrier
15 Protruding threads
16 Receiving threads
17 Receiving groove
18 Protruding nub
19 Grab window
20 Predetermined decoration or photograph example
21 Display Space

DETAILED DESCRIPTION PREFERRED EMBODIMENT

Preferred embodiment of this invention is made of plastic. As shown in FIGS. 1A–3D a clear outer casing (10) is connected to a clear bottom lid (11) surrounding a hollow container (12). Between the hollow container (12) and the outer casing (10) is the display space (21). The outer casing (10) and hollow container (12) are fit to create a stop barrier (14). This barrier (14) forms the top of the display space (21). The bottom of the outer casing (10) has a grab window (19). The grab window (19) allows for easier access to the photograph or decoration (20) placed in the display space (21).

As shown in FIGS. 3A–3D, the top of the outer casing (10) has receiving threads (16) for a top lid (13). The children's training top lid (13) has protruding threads (15) to fit with the outer casing receiving threads (16). Fitted threads (15, 16) secure the top lid (13) to the outer casing (10). A secured top lid (13) ensures contents of the hollow container (12) are protected.

As shown in FIGS. 4A and 4B, a photograph or decoration example (20) can be displayed within the completed container. The top lid is used to protect the contents of the inner cup during the decoration (20) insertion or removal. The bottom of the decoration (20) remains exposed in the grab window (19). The grab window (19) allows a human to insert and remove the decoration (20) easily.

The Preferred Operational Embodiment is shown in FIGS. 5A–5C, a container for children displaying a predetermined decoration (20).

Other embodiments will include the outer casing and the bottom lid. The parts will be made of other clear materials such as glass. The outer casing can be applied to accommodate larger drinking, serving or storage hollow vessels. The photo display benefit will be added to existing and new types of hollow container vessels.

Conclusion Ramifications and Scope

A Photo display container with a clear outer casing and clear bottom lid allows decorations to be updated easily and often. Predetermined decorations will be inserted and removed without any manipulation or special matting or backing needed. The display container for children allows caregivers to keep the decorations current. The decorations can include a child's parents, distant relative or favorite pet. The outer casing and bottom lid can be customized in manufacturing to transform many types of hollow vessels into display containers.

The scope of the invention should be determined by the appended claims and their legal equivalents, rather than by the examples given.

I claim:

1. A container for displaying easily inserted and removable predetermined decorations, comprising:

a hollow container vessel having an upper end and a lower end and an opening at the top;

a clear tubular solid outer casing having an upper end and a lower end, means to accept a top lid at the upper end and means to accept a bottom lid at the lower end;

a grab window formed by a cutout at the lower end of the outer casing;

the top lid connected to the outer casing such that contents of the hollow vessel are protected; and a clear solid bottom lid connected to the outer casing such that the grab window is covered and the inserted decoration is protected.

2. The container of claim 1 wherein:

the outer casing surrounds the hollow vessel to form a display space with a stop barrier at the upper end;

the stop barrier is formed where the upper end of the outer casing and the upper end of the hollow vessel meet and limit the entry of the decoration inserted into the display space.

3. The container of claim 1 wherein the predetermined decoration, having an upper edge and a lower edge, is inserted into the display space through the grab window until the top edge of the decoration meets the stop barrier, and the lower edge of the decoration is exposed in the grab window and aligned with the bottom edge of the hollow vessel.

* * * * *